US008641156B2

(12) United States Patent
Chow

(10) Patent No.: US 8,641,156 B2
(45) Date of Patent: Feb. 4, 2014

(54) COMPOUND MOTION SHELF ORGANIZER

(76) Inventor: Peter Chow, Oak Park, CA (US)

( * ) Notice: Subject to any disclaimer, the term of this patent is extended or adjusted under 35 U.S.C. 154(b) by 222 days.

(21) Appl. No.: 13/157,266

(22) Filed: Jun. 9, 2011

(65) Prior Publication Data

US 2012/0313494 A1 Dec. 13, 2012

(51) Int. Cl.
*A47B 67/02* (2006.01)

(52) U.S. Cl.
USPC ..... 312/247

(58) Field of Classification Search
USPC ..... 312/246, 247, 319.1, 319.4, 309, 310, 312/312, 306, 298, 301
See application file for complete search history.

(56) References Cited

U.S. PATENT DOCUMENTS

| | | | | | |
|---|---|---|---|---|---|
| 912,921 | A * | 2/1909 | Ucker | 312/249.7 |
| 1,973,628 | A * | 9/1934 | Hindle | 312/235.1 |
| 2,341,434 | A * | 2/1944 | Forbes | 414/280 |
| 2,506,086 | A * | 5/1950 | Jess | 312/247 |
| 2,634,186 | A * | 4/1953 | Zuss | 312/201 |
| 2,767,041 | A * | 10/1956 | Burger et al. | 312/298 |
| 2,919,966 | A * | 1/1960 | Preston | 312/27 |
| 3,028,209 | A * | 4/1962 | Hinkel et al. | 312/319.7 |
| 3,078,133 | A * | 2/1963 | Schauer | 312/321.5 |
| 3,081,138 | A * | 3/1963 | Stebbins | 312/319.3 |
| 3,734,588 | A * | 5/1973 | Ellis | 312/247 |
| 4,076,351 | A * | 2/1978 | Wyant | 312/247 |
| 5,586,816 | A * | 12/1996 | Geiss, II | 312/301 |
| 6,247,771 | B1 * | 6/2001 | Miller | 312/310 |
| 6,484,893 | B1 * | 11/2002 | Tkatch | 211/94.02 |
| 6,702,411 | B2 * | 3/2004 | Helver | 312/333 |
| 6,755,492 | B1 * | 6/2004 | Hyde et al. | 312/247 |
| 7,178,887 | B2 * | 2/2007 | Steadman | 312/311 |
| 7,770,986 | B1 * | 8/2010 | Simaitis | 312/247 |
| 8,052,230 | B2 * | 11/2011 | Vicek | 312/247 |
| 8,113,606 | B2 * | 2/2012 | Greenberg | 312/271 |
| 8,157,108 | B1 * | 4/2012 | Waldrop | 211/1.57 |

FOREIGN PATENT DOCUMENTS

| | | | |
|---|---|---|---|
| DE | 2344640 A | * | 3/1975 |
| DE | 19923494 C1 | * | 1/2001 |

OTHER PUBLICATIONS

Machine translation of Dröge, DE 19923494 published Jan. 2001.*

* cited by examiner

*Primary Examiner* — Matthew Ing
(74) *Attorney, Agent, or Firm* — SoCal IP Law Group LLP; John E. Gunther; Steven C. Sereboff

(57) ABSTRACT

A compound motion shelf organizer may include a front module and a rear module. A compound linear motion system may be coupled between the front module and a base. The compound linear motion system may be configured to allow the front module to move horizontally with respect to the base from a retracted position to a forward position, and to allow the front module to move vertically with respect to the base from the forward position to a downward position.

15 Claims, 5 Drawing Sheets

© Peter Chow 2011

© Peter Chow 2011

© Peter Chow 2011

© Peter Chow 2011

© Peter Chow 2011

COMPOUND MOTION SHELF ORGANIZER

NOTICE OF COPYRIGHTS AND TRADE DRESS

A portion of the disclosure of this patent document contains material which is subject to copyright protection. This patent document may show and/or describe matter which is or may become trade dress of the owner. The copyright and trade dress owner has no objection to the facsimile reproduction by anyone of the patent disclosure as it appears in the Patent and Trademark Office patent files or records, but otherwise reserves all copyright and trade dress rights whatsoever.

BACKGROUND

1. Field

This disclosure relates to a sliding shelf organizer.

2. Description of the Related Art

Various items may be stored or displayed on shelves. For example merchandise such as canned goods and other packaged food items may be presented on shelves in a store; parts may be stored on shelves in a warehouse; CDs, DVDs, and other media may be stored on shelves in an home entertainment center. Commonly, shelves have sufficient depth that items may be stored in rows such that some items are disposed behind other items. However, a person may have difficulty viewing and accessing items at the back of the shelf. This problem may be partially resolved by installing a sliding drawer on a shelf. However, conventional sliding drawers do not substantially improve visibility and accessibility for shelves located near or above a user's eye level.

Throughout this description, elements appearing in figures are assigned three-digit reference designators, where the most significant digit is the figure number where the element is first described and the two least significant digits are specific to the element. An element that is not described in conjunction with a figure may be presumed to have the same characteristics and function as a previously-described element having the same reference designator. Pairs of mirror-image elements having the same function may be given a single reference designator with a suffix of "L" or "R" indicating "left" or "right".

DETAILED DESCRIPTION

Description of Apparatus

In this patent, the term "linear motion system" means a mechanism that allows motion along a linear axis. A linear motion system may include a first portion, herein called a "rail", and a second portion, herein called a "carriage". In a typical application, a carriage may slide or move linearly along or within a fixed rail. In other applications, the carriage may remain in a fixed location while the rail moves, or both the carriage and the rail may move. A carriage may simply glide in contact with a rail. Wheels and/or bearings, such as ball bearings or crossed roller bearings, may be disposed between the carriage and the rail. A "slide" is a specific type of linear motion system commonly used in pairs to support drawers in cabinets and other furniture. A slide includes an elongated carriage that moves within a channel-shaped rail. Typically, a pair of rails are attached to a cabinet and a drawer or sliding shelf is attached to the carriages. When moved, a substantial portion of each carriage may extend out of the respective rail, such that the drawer or shelf supported by the carriage is cantilevered in front of the cabinet.

In this patent, the term "compound linear motion system" means a mechanism that allows motion on two orthogonal linear axes. A compound motion shelf organizer incorporates a compound linear motion system that provides for both horizontal and vertical motion of at least a portion of a shelf assembly. A compound linear motion system may consist of a vertical linear motion system and a horizontal linear motions system. In this patent, the term "vertical" has its conventional meaning of normal to the plane of the horizon or normal to the surface of the earth. The term "horizontal" means any direction normal to the vertical.

In this patent, the term "attached" means "a non-movable mechanical connection". Two elements may be attached by means of fasteners such as screws or rivets, by adhesive bonding, by thermal bonding, brazing, welding, or some other process. The term "attached" does not preclude two elements being integral. Two elements may be "attached" by virtue of being portions of the same physical object.

Figure 1:
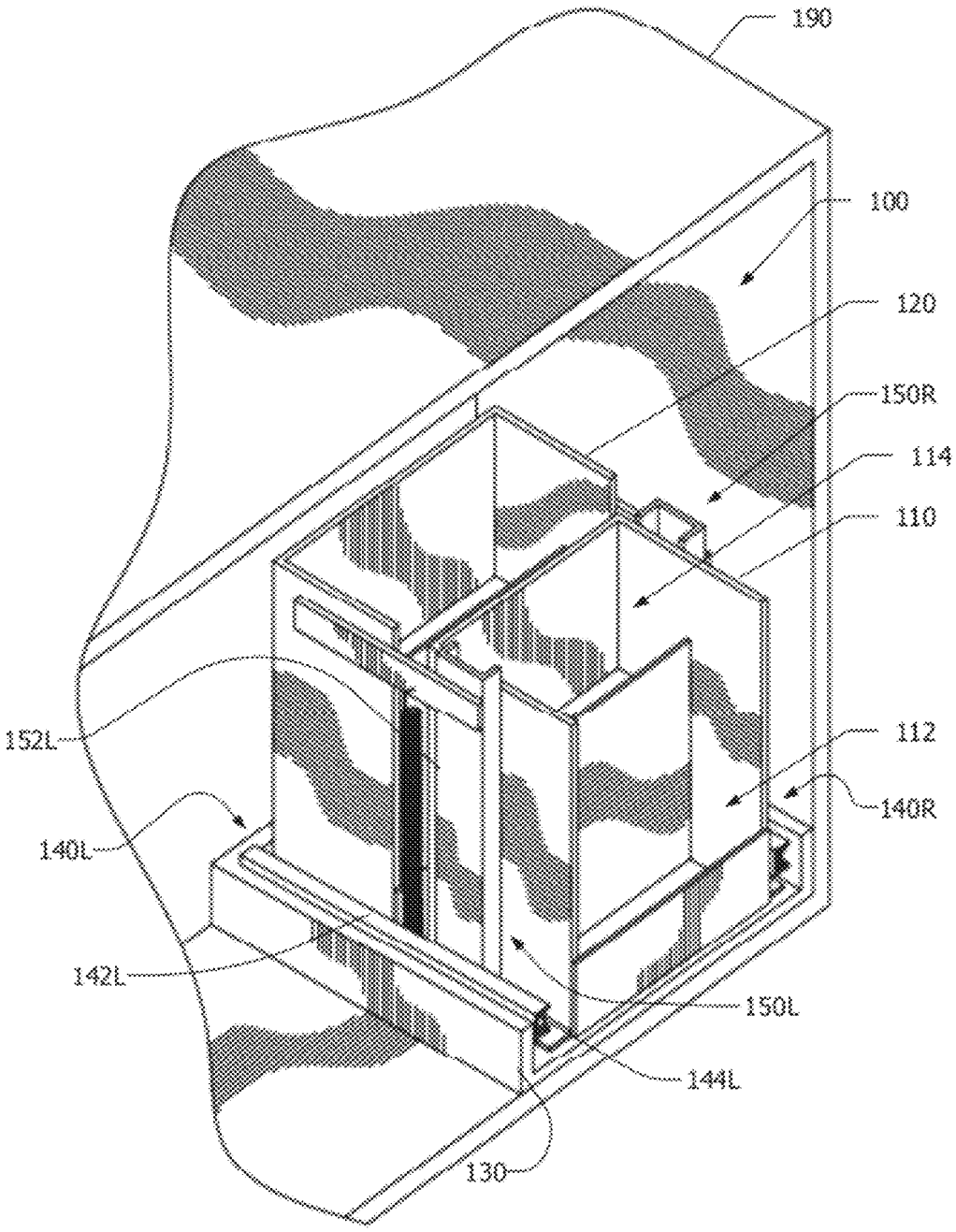
FIG. 1 is a perspective view of a compound slide shelf organizer in a retracted position.

FIG. 1 shows a compound motion shelf organizer (CMSO) 100 in a fully retracted position. The relative position of various parts of the CMSO 100 will be described based upon this view. For example, terms such as top, bottom, front, rear, left and right are used. These directions refer to the CMSO as seen in the figures and are not necessarily absolute terms.

The CMSO 100 may be mounted on a support structure 190. In the example of FIG. 1, the support structure 190 is shown as a cabinet. However, the CMSO 100 may be mounted to another structure, such as a shelf, a frame, a wall, or some other structure. The CMSO 100 may include a front module 110, a rear module 120, and a base 130. The base 130 may be attached to, or part of, the support structure 190.

In the example of FIG. 1, the front module 110 includes a first bin 112 and a second bin 114 disposed behind and above the first bin 112. The first bin 112 and the second bin 114 may be configured to hold items such as canned goods, packaged food, CDs or other entertainment media, packaged medical items such as drugs, small mechanical parts, dishes such as cups or mugs, or other items. Dividing the front module 110 into first and second bins is exemplary. The front module 110 may have more than two bins. The front module 110 may be a single bin, a basket, a tray, one or more shelves, or some other configuration.

The front module 110 may be formed, for example by injection molding, as a single piece. The front module 110 may be formed by assembling two or more pieces of material. The front module 110 may be formed from any appropriate material including plastic, wood, sheet metal, and combinations thereof. The rear module 120 and the base 130 may be similarly constructed.

The front module 110 may be coupled to the base 130 through a compound linear motion system. For example, the compound linear motion system may include a left horizontal slide 140L, a left vertical slide 150L, a right horizontal slide 140R, and a right vertical slide 150R. A rail 142L of the left horizontal slide 140L may be attached to the base 130. A carriage 144L of the left horizontal slide 140L may be attached to a rail 152L of the left vertical slide 150L. The carriage 144L may also be attached to or part of the rear module 120. A carriage (not visible) of the left vertical slide 150L may be attached to or part of the front module 110. The right horizontal slide 140R and the right vertical slide 150R may be similarly configured.

Figure 2:
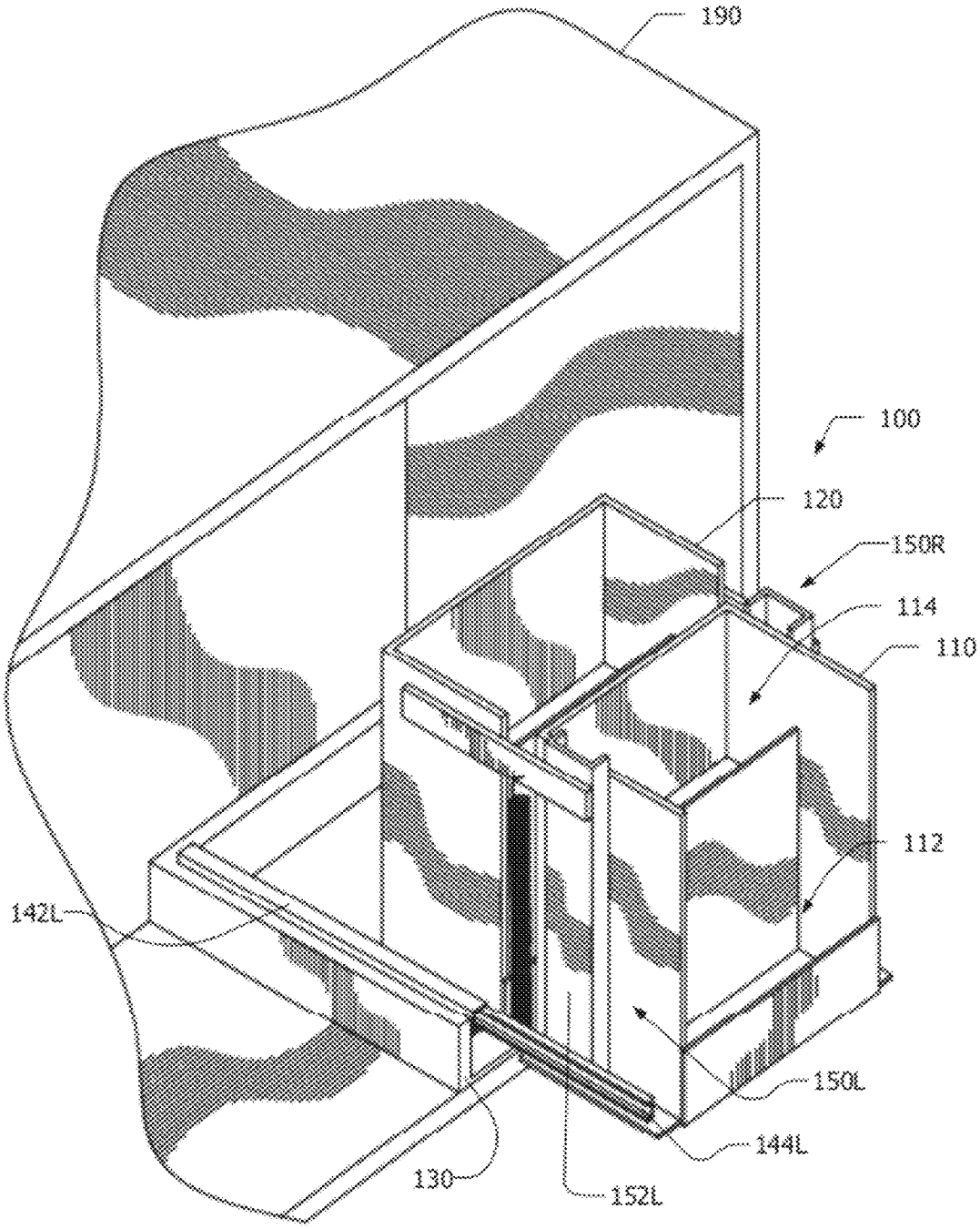
FIG. 2 is a perspective view of a compound slide shelf organizer in a partially extended position.

FIG. 2 shows the CMSO 100 in an intermediate or forward position. In FIG. 2, the carriage 144L of the left horizontal slide 140L and the carriage (not visible) of the right horizontal slide 140R have been moved forward. Accordingly, the left and right vertical slides 150L, 150R (which are attached to the carriages of the horizontal slides 140L, 140R) and the front module 110 (which is attached to the vertical slides) have moved forward. The rear module 120, which may be attached to the carriages of the horizontal slides, is also shown to have moved forward.

As shown in FIG. 2, the front module 110 may be positioned in front of the base 130. First latches (not shown) may be used to hold the front module in this position. The first latches may be, for example, magnetic or mechanical latches. The first latches may be incorporated, in whole or in part, into the left and right vertical slides 150L, 150R. When the first latches are released, the front module 110 may be movable downward along the vertical slides 150L, 150R.

Figure 3:
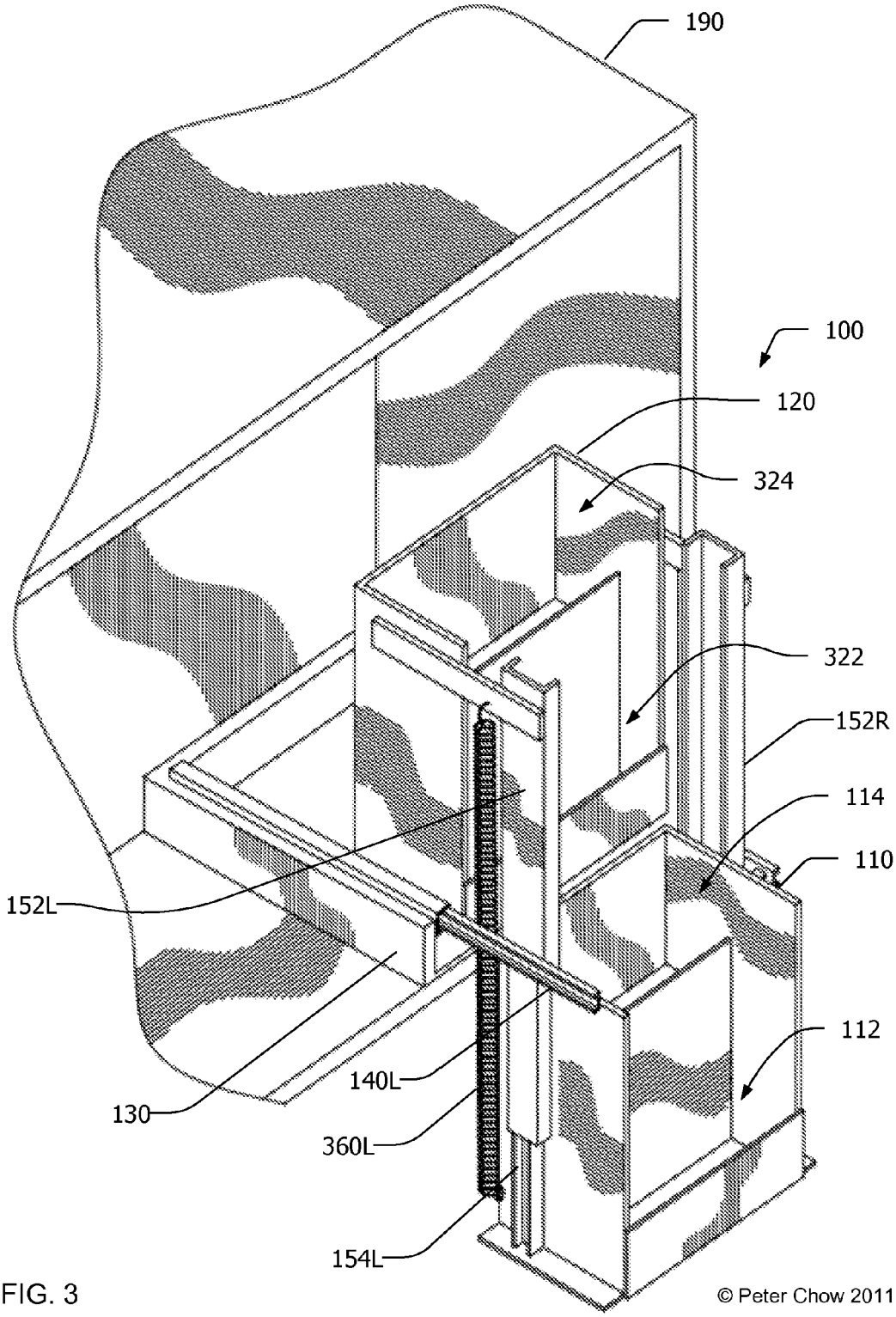
FIG. 3 is a perspective view of a compound slide shelf organizer in a fully extended position.

FIG. 3 shows the compound slide shelf organizer (CMSO) 100 in a fully extended or downward position. In FIG. 3, the carriage 154L of the left vertical slide 150L and the carriage (not visible) of the right vertical slide have been moved downward from the positions shown in FIG. 2. Accordingly, the front module 110 (which is attached to the vertical slides) has moved downward. With the front module 110 in the downward position, items disposed on the rear module 120 are easily accessible.

In the example of FIG. 3, the rear module 120 includes a third bin 322 and a fourth bin 324 disposed behind and above the third bin 322. The third bin 322 and the fourth bin 324 may be configured to hold items such as canned goods, packaged food, CDs or other media, or other items. Dividing the rear module 120 into third and fourth bins is exemplary. The rear module 120 may have more than two bins. The rear module 120 may be a single bin, a basket, a tray, one or more shelves, or some other configuration.

A coil spring 360L may be provided to lift a portion of the weight of the front module and its contents such that a user does not have to lift the entire weight when moving the front module upward from the fully extended position. A similar spring (not visible) may be disposed on the right side of the CMSO. Some other counterbalance mechanism, such as a gas-filled piston, a flat spring, or a counterweight, may be used instead of or in addition to the coil spring 360L to compensate for the weight of the front module 110 and its contents. Second latches (not shown) may be used to hold the front module in this position when the weight of the first module and its contents are less than the upward force provided by the coil springs or other counterbalance mechanism. The second latches may be, for example, magnetic or mechanical latches. The second latches may be incorporated, in whole or in part, into the left and right vertical slides 150L, 150R.

Figure 4:
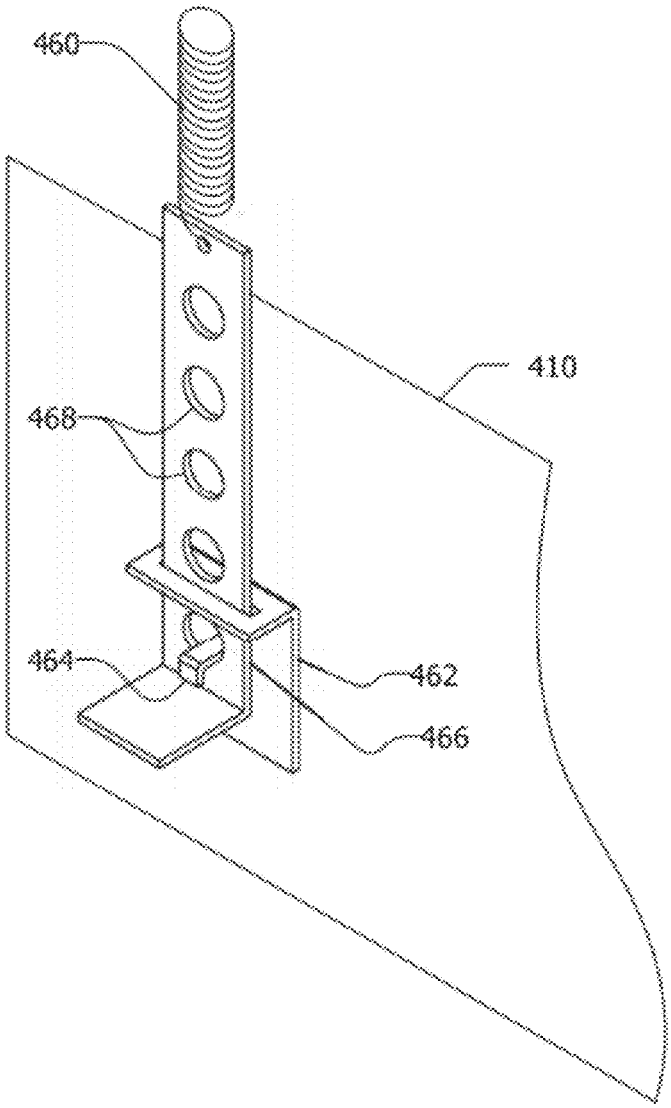
FIG. 4 is a perspective detail view of a spring tension adjuster.

The tension of the coil spring 360L or other counterbalance mechanism may be adjustable to adapt to different applications of the CMSO. For example, A CMSO use to hold canned food or automotive parts may require a stronger counterbalance force than a CMSO used to store package dry food items or entertainment media. FIG. 4 shows an exemplary technique for adjusting the tension of a coil spring 460. The spring 460 terminates in a keeper 466 provided with a plurality of holes 468. A tab 464 may extend from a side of a front module 410. The tension of the spring 460 may be selected by positioning the keeper such that the tab 464 engages one of the holes 468. The tab 464 may be part of the front module 410 or may be part of a bracket 462 attached to the front module 110. The bracket 462 may be configured with a slot to capture the keeper 466 and thus prevent inadvertent disconnection of the counterbalance spring 460 from the front module 410.

Figure 5A:
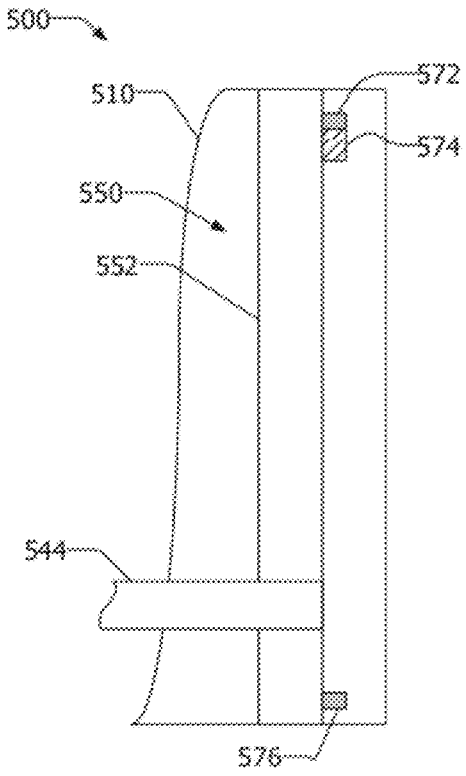
FIG. 5A is a partial side view of a compound slide shelf organizer in a partially extended position.

FIG. 5A shows a partial side view of a CMSO 500 in a forward position similar to that shown in FIG. 2. The CMSO 500 may include a front module 510, a portion of which is shown in FIG. 5A. The front module 510 may be coupled to a vertical slide 550, of which only the rail 552 is visible in FIG. 5A. The rail 552 may be coupled to and supported by a carriage 544 of a horizontal slide. The horizontal slide may be connected to a second module (not shown) and a base or other supporting structure (not shown).

An upper position for the travel of the front module 510 may be defined by the intersection of an upper stop 572 and a block 574 that extends from the front module 510. The block 574 may be attached to or part of the front module 510. The upper stop 572 may be attached to or part of the rail 552 of the vertical slide 550. The upper stop 572 and the block 574 may collectively function as a first latch to retain the front module in the upper position. For example, one of the upper stop 572 and the block 574 may be or include a magnet and the other may be or include a ferromagnetic material. The attraction of the magnet to the ferromagnetic material may retain the front module 510 in its upper portion. The upper stop 572 and the block 574 may engage or latch mechanically to retain the front module 510 in its upper position.

Figure 5B:
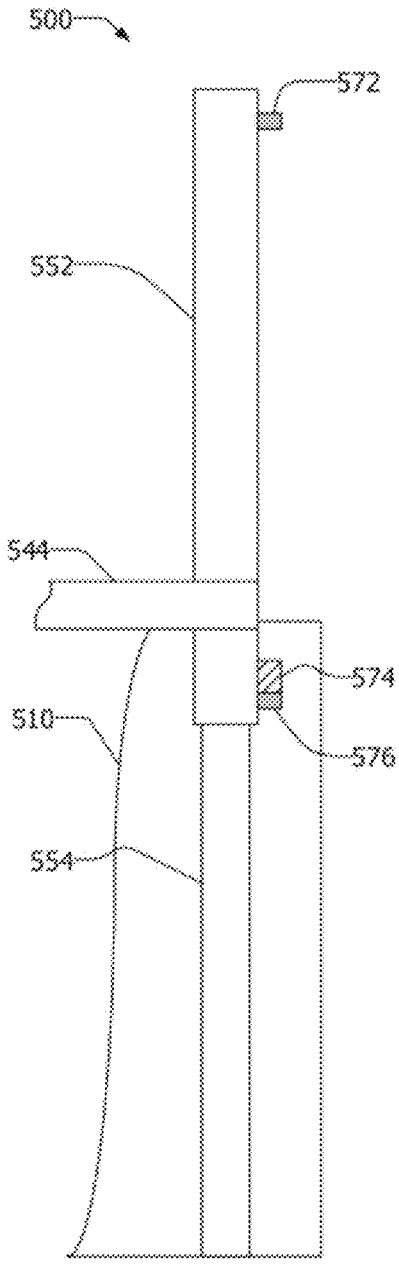
FIG. 5B is a partial side view of a compound slide shelf organizer in a fully extended position.

FIG. 5B shows a partial side view of the CMSO 500 in a downward position similar to that shown in FIG. 3. In FIG. 5B, the front module 510 has been moved to a downward position along the vertical, of which the rail 552 and carriage 554 are visible in FIG. 5A.

A lower position for the travel of the front module 510 may be defined by the intersection of a lower stop 576 and the block 574 extending from the front module 510. The lower stop may be attached to or part of the rail 552 of the vertical slide 550. The lower stop 576 and the block 574 may collectively function as a second latch to retain the front module in the lower position. For example, one of the lower stop 576 and the block 574 may be or include a magnet and the other may be or include a ferromagnetic material. The attraction of the magnet to the ferromagnetic material may retain the front module 510 in its lower portion. The lower stop 576 and the block 574 may engage or latch mechanically to retain the front module 510 in its lower position.

The use of horizontal and vertical slides, as shown in the figures, is exemplary. A CMSO may use different types of linear motion systems instead of, or in combination with, slides. For example, horizontal motion of a forward module may be provided by left and right horizontal slides and vertical motion of the forward module may be provided by a simpler linear motion system such as a pair of carriages that glide along round or trapezoidal rails.

Closing Comments

Throughout this description, the embodiments and examples shown should be considered as exemplars, rather than limitations on the apparatus and procedures disclosed or claimed. Although many of the examples presented herein involve specific combinations of method acts or system elements, it should be understood that those acts and those elements may be combined in other ways to accomplish the same objectives. With regard to flowcharts, additional and fewer steps may be taken, and the steps as shown may be combined or further refined to achieve the methods described herein. Acts, elements and features discussed only in connection with one embodiment are not intended to be excluded from a similar role in other embodiments.

As used herein, "plurality" means two or more. As used herein, a "set" of items may include one or more of such items. As used herein, whether in the written description or the claims, the terms "comprising", "including", "carrying", "having", "containing", "involving", and the like are to be understood to be open-ended, i.e., to mean including but not limited to. Only the transitional phrases "consisting of" and "consisting essentially of", respectively, are closed or semi-closed transitional phrases with respect to claims. Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements. As used herein, "and/or" means that the listed items are alternatives, but the alternatives also include any combination of the listed items.

The invention claimed is:

1. A compound motion shelf organizer comprising:

a front module;

a rear module comprising a rear wall and at least one sidewall extending forward from the rear wall, the rear module being disposed entirely behind the front module at all times;

a compound linear motion system coupled to the front module, the rear module, and a base, the compound linear motion system configured:

to allow the front module and the rear module to move horizontally with respect to the base from a retracted position to a forward position, and to allow the front module to move vertically with respect to the rear module and the base from the forward position to a downward position, wherein items disposed on the rear module may be easily viewed and accessed when the front module is in the downward position.

2. The compound motion shelf organizer of claim 1, wherein the compound linear motion system comprises:

a horizontal linear motion system configured to allow the front module to move horizontally from the retracted position to the forward position; and a vertical linear motion system configured to allow the front module to move vertically from the forward position to the downward position.

3. The compound motion shelf organizer of claim 2, wherein the horizontal linear motion system comprises left and right horizontal slides.

4. The compound motion shelf organizer of claim 2, wherein the vertical linear motion system includes a vertical carriage attached to the front module and a vertical rail, the horizontal linear motion system includes a horizontal carriage attached to the vertical rail and a horizontal rail coupled to the base.

5. The compound motion shelf organizer of claim 2 wherein the vertical linear motion system further comprises a ferromagnetic stop.

6. The compound motion shelf organizer of claim 1, wherein the front module is one of a shelf, a plurality of shelves, a basket, a bin, and a plurality of bins.

7. The compound motion shelf organizer of claim 1, wherein the front module is configured to hold one or more of canned food items, packaged food items, entertainment media, packaged medical items, small mechanical parts, and dishes.

8. The compound motion shelf organizer of claim 1, further comprising:

one or more first latches to maintain the front module in the forward position.

9. The compound motion shelf organizer of claim 8, further comprising:

one or more second latches to maintain the front module in the downward position.

10. The compound motion shelf organizer of claim 9, wherein at least a portion of the one or more first latches and the one or more second latches are integral to the vertical linear motion system.

11. The compound motion shelf organizer of claim 1, further comprising:

a counterbalance to compensate, at least in part, for the weight of the front module and its contents.

12. The compound motion shelf organizer of claim 11, wherein the counterbalance includes one or more of a spring, a plurality of springs, a piston, and a counterweight.

13. The compound motion shelf organizer of claim 11, wherein the counterbalance is one or more springs and a tension of the one or more springs is adjustable.

14. The compound motion shelf organizer of claim 1, wherein the rear module is one of a shelf, a plurality of shelves, a basket, a bin, and a plurality of bins.

15. The compound motion shelf organizer of claim 1, wherein the rear module is configured to hold one or more of canned food items, packaged food items, entertainment media, packaged medical items, small mechanical parts, and dishes.

* * * * *